US005957775A

United States Patent [19]

Cherry

[11] Patent Number: 5,957,775

[45] Date of Patent: Sep. 28, 1999

[54] WAGERING GAME BASED ON RANKING ORDER OF GAME PARTICIPANTS

[75] Inventor: Eric Cherry, Highland Beach, Fla.

[73] Assignee: Horse Sense Corporation, Delary Beach, Fla.

[21] Appl. No.: 08/886,193

[22] Filed: Jul. 1, 1997

[51] Int. Cl.[6] ..... A63F 9/22

[52] U.S. Cl. ..... 463/16

[58] Field of Search ..... 436/1, 6, 16, 20, 436/25, 28; 273/139, 143 R, 237, 256

[56] References Cited

U.S. PATENT DOCUMENTS 4,373,723 2/1983 Brown et al. .
4,962,950 10/1990 Champion .
5,374,060 12/1994 Goldberg .
5,411,258 5/1995 Wilson et al. .
5,564,701 10/1996 Dettor .
5,564,977 10/1996 Algie .

*Primary Examiner*—Michael O'Neill
*Attorney, Agent, or Firm*—Fish & Richardson P.C.

[57] ABSTRACT

A wagering game played by a player includes a set of game participants, an identification number assigned to each of the game participants, and a game number. The player places a wager based on the game number, and a ranking order of the game participants is determined, such as by a race. The sum of the identification numbers of a subset of the game participants is calculated, the subset of game participants having a predetermined number of game participants selected on the basis of the ranking order of the game participants. Whether the player's wager is a winning wager is determined by comparing the sum to the game number. The wagering game may be implemented as an electronic game.

30 Claims, 3 Drawing Sheets

WAGERING GAME BASED ON RANKING ORDER OF GAME PARTICIPANTS

BACKGROUND OF THE INVENTION

This invention relates to a wagering game, and in particular, a game in which wagers are placed with respect to a ranking order of game participants such as in a race.

A typical horserace includes, e.g., eight racing horses. Each horse is assigned a post number, e.g., 1 through 8. The horses race against each other to cross a finish line.

Game players place wagers that a particular race horse or a combination of race horses will finish the race in a particular order, e.g., first, second and third place. Bets are usually placed on the horses according to their post numbers. One standard bet involves guessing which three horses will cross the finish line first, second and third, respectively.

SUMMARY OF THE INVENTION

In general, in one aspect, the invention features a method of playing a wagering game by a player. A set of game participants is selected. An identification number is assigned to each of the game participants, and a game number is selected. The player places a wager based on the game number, and a ranking order of the game participants is determined. The sum of the identification numbers of a subset of the game participants is calculated, the subset of game participants having a predetermined number of game participants selected on the basis of the ranking order of the game participants. Whether the player's wager is a winning wager is determined by comparing the sum to the game number.

Implementations of the invention may include one or more of the following features. A payout may be provided for a winning wager. The payout may be determined on a parimutuel basis or may be based on predetermined odds. The player may guess the ranking order of the game participants to place the wager.

The ranking order may be determined by a race. The race may be a horserace, the game participants may be racing horses, and the identification numbers may be post numbers of the racing horses. The ranking order may be determined by a series of sporting events and the game participants may be sports teams.

The wager may be that the sum is equal to, less than, or greater than the game number. The predetermined number may be three. The game number may be selected by a wagering authority.

In general, in another aspect, the invention features a method of playing a wagering horserace game by a player. A set of racing horses is selected. A post number is assigned to each of the racing horses, and a game number is selected. The player places a wager based on the game number, and a finishing order of the racing horses is determined by a horserace. The sum of the post numbers of the first three racing horses to finish the horserace is calculated. Whether the player's wager is a winning wager is determined by comparing the sum to the game number. A payout is provided for a winning wager.

In general, in another aspect, the invention features an electronic gaming device for playing a wagering game by a player. A screen displays a game number and a set of game participants, each game participant being assigned an identification number. A processor determines a ranking order of the game participants and calculates the sum of the identification numbers of a subset of the game participants, the subset of game participants comprising a predetermined number of game participants selected on the basis of the ranking order. The player places a wager based on the game number, and the player's wager is determined to be a winning wager by comparing the sum to the game number.

Implementations of the invention may include one or more of the following features. The processor may calculate a payout to the player for a winning wager and provide the payout. The payout may be determined on a parimutuel basis or may be based on predetermined odds. The player may guess the ranking order of the game participants to place the wager.

The ranking order may be determined by a race. The wager may be that the sum is equal to, less than, or greater than the game number.

The wagering game of the present invention has the advantage that it is a simple game that can be played along with other standard wagering games.

The wagering game of the present invention has the further advantage of allowing players to place wagers on combinations of known probabilistic events.

Other features and advantages of the invention will become apparent from the following detailed description, and from the claims.

DESCRIPTION OF THE PREFERRED EMBODIMENTS

The wagering game of the present invention involves, e.g., the game players placing wagers with respect to the post numbers of the racing horses.

Figure 1:
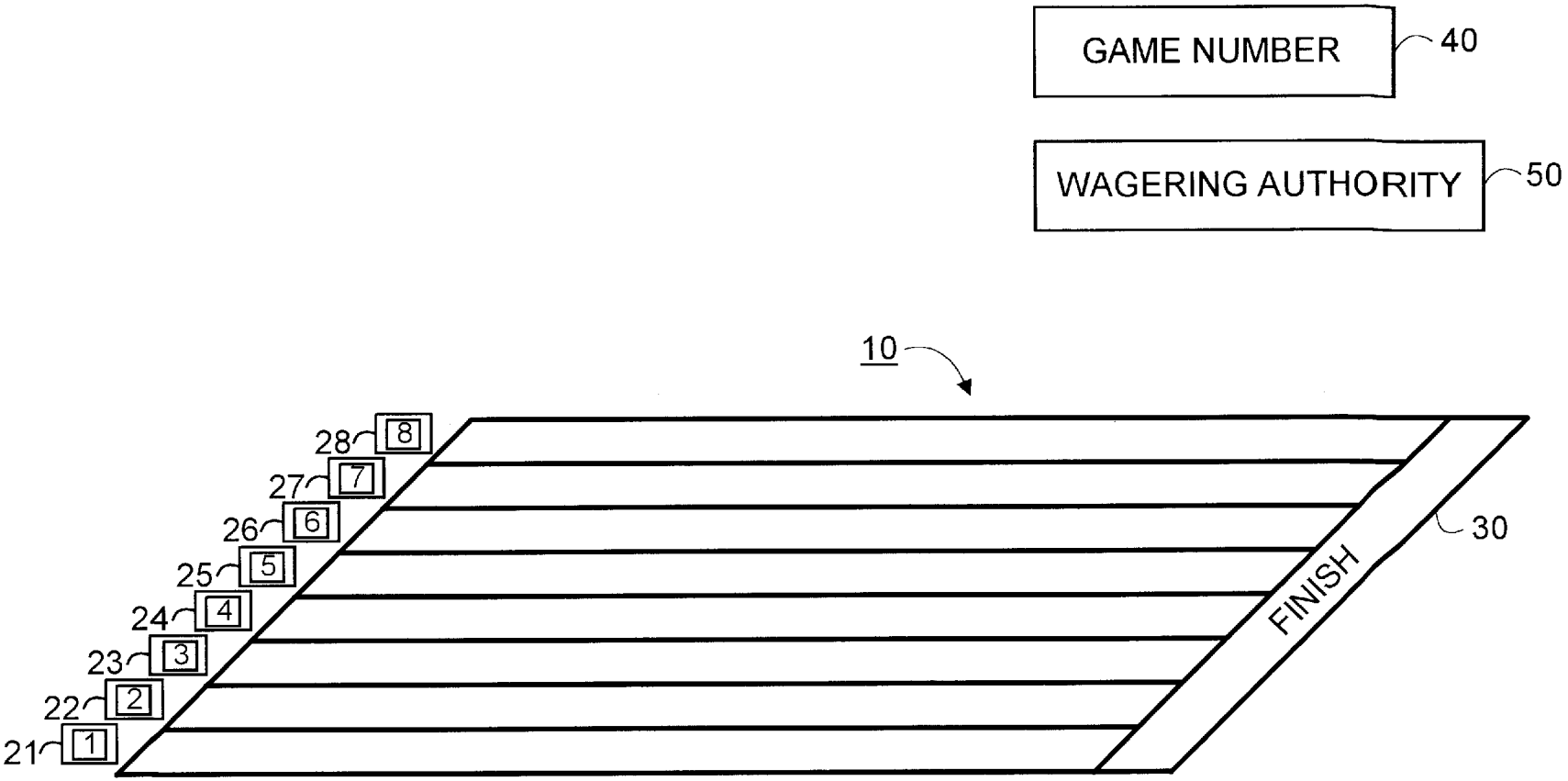
FIG. 1 shows a horserace wagering game according to the present invention.

As shown in FIG. 1, game 10 includes game participants 21–28. Participants 21–28 compete against each other to reach a finishing point 30. In the example described herein, the game participants 21–28 are racing horses racing against each other to cross a finish line 30.

Each of game participants 21–28 is assigned an identification number. For example, race horses 21–28 are assigned identification numbers in the form of post numbers 1–8, respectively.

The wagering game of the present invention also includes choosing a game number 40. Game number 40 is a number chosen artificially, e.g., based on a statistical analysis of the probabilistic outcomes of the game being played. In particular, game number 40 may be chosen with respect to the identification numbers of the game participants and the likely ranking order of the game participants in reaching the finishing point 30. The game number 40 may be different for every race.

The game players place wagers with a wagering authority 50 concerning the mathematical relationship of the identification numbers 1–8 of the participants 21–28 to the game number 40. In a preferred embodiment, the game players place wagers that the sum of the identification numbers of the first three game participants to reach the finishing point 30 will be greater than, less than, or equal to the game number 40. Payouts may be provided for winning wagers by wagering authority 50.

For example, prior to the start of a horserace, when players may place wagers, a game number, e.g. 15, is chosen by the wagering authority 50. Players guess the finishing order of the racing horses, each of which is assigned a post number from 1 through 8. Each player then adds the post numbers of the three racing horses that he believes will be the first, second and third horses to cross the finish line 30 during the race. If the player guesses that racing horses 22, 25 and 27 will be the first three racing horses to cross finish line 30, the sum of the post numbers for these horses is 2+5+7=14. Thus, the player may wish to place a wager that the sum of the post numbers of the first three horses to cross the finish line during the race will be less than the game number, since 14 is less than 15.

In this example, if horses 22, 25 and 27 are the first three horses to cross the finish line, then the player's wager that the sum of the post numbers of the first three horses to cross the finish line will be less than 15 is a winning wager. If horses 21, 25 and 27 are the first three horses to cross the finish line, then the player's wager that the sum of the post numbers (1+5+7=13) of the first three horses to cross the finish line will be less than 15 is still a winning wager. However, if horses 25, 26 and 27 are the first three horses to cross the finish line, then the player's wager that the sum of the post numbers (5 +6+7=18) of the first three horses to cross the finish line will be less than 15 is not a winning wager.

Payouts to winning players may be determined on a parimutuel basis. A parimutuel wagering scheme includes a betting pool in which players who bet on game participants finishing in the first predetermined number of places share the total amount bet by all players, minus a percentage retained by the wagering authority. Such a scheme allows payouts to winning players to change throughout the period of time when wagers may be placed, while the players are placing their wagers. The payout to players who place winning wagers depends on the number of players that place winning wagers and the number of players that place non-winning wagers.

In such a parimutuel wagering scheme, players may be apprised of the changing payouts for the various possible wagers throughout the period of time when wagers may be placed. In particular, the payout to a player for a winning wager may be determined at the time the wager is placed. Accordingly, payouts will be higher for wagers that are chosen by fewer players than those chosen by the other remaining players. Thus, players are encouraged to place wagers on the less popular wagers that provide higher payouts. Such a scheme tends to stabilize the payout to players that place winning wagers because the players' wagers are more evenly distributed among the possible wagers.

Alternately, payouts to winning players may be based on predetermined odds that do not change during the period of time when wagers may be placed.

The wagering game of the present invention may be applied to any order-dependent participation game such as a racing game, or any ranking scheme including a series of sporting events for sports teams such as football, soccer and basketball games.

Figure 2:
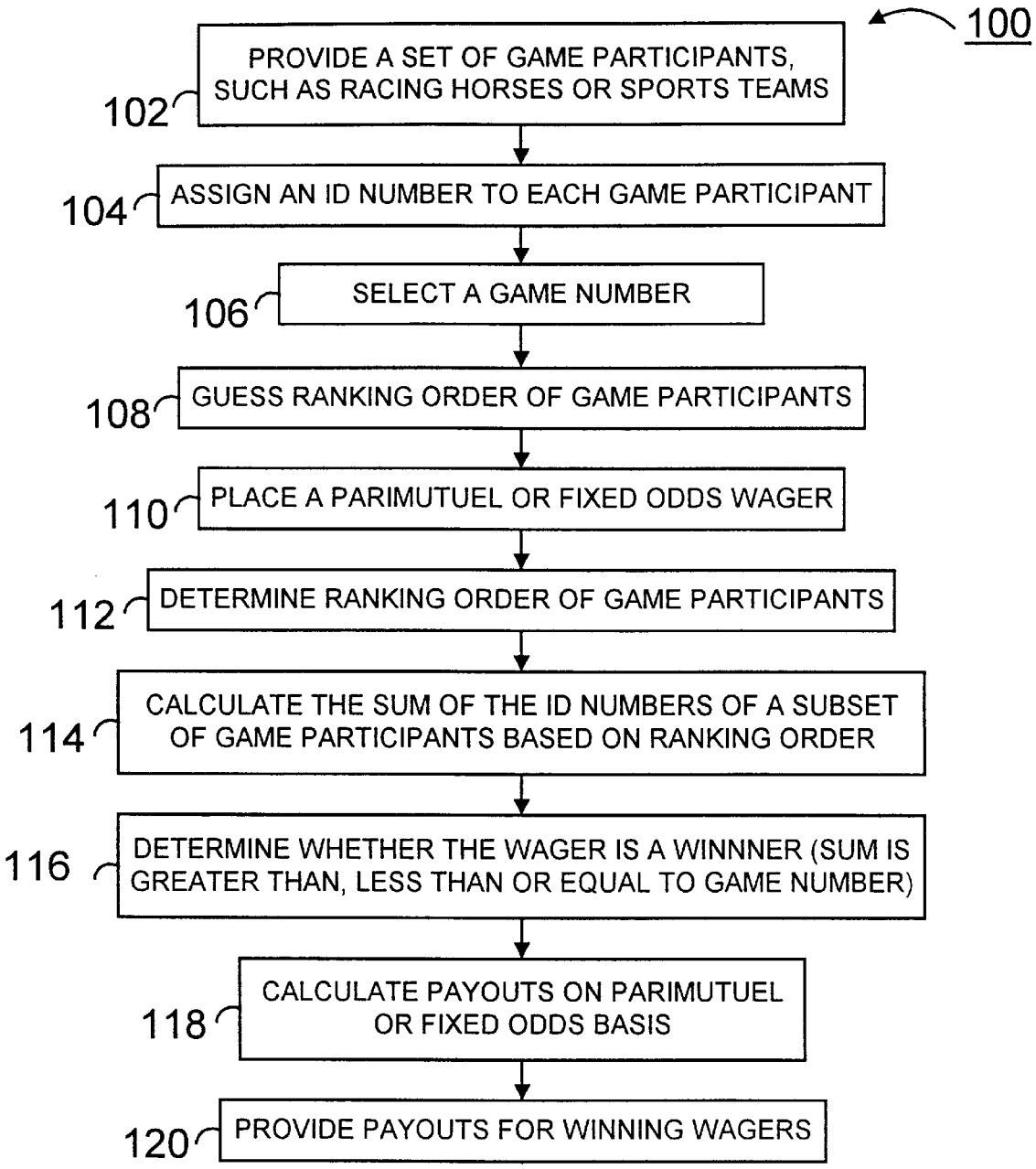
FIG. 2 is a flow chart showing a method of playing the wagering game of the present invention.

FIG. 2 shows a method 100 of playing the wagering game of the present invention. A set of game participants, such as racing horses or sports teams, is selected (step 102). Each of the game participants is assigned an identification number (step 104).

The wagering authority selects a game number (step 106). Each player guesses what the ranking order will be for the game participants, e.g. for the racing horses or sports teams after the horserace or series of sporting events (step 108). Each player then places a wager based on the game number and the sum of the identification numbers of the game participants for a group of the game participants based on the player's guess as to the ranking order (step 110).

The ranking order of the game participants is then determined, e.g., by a horse race or a series of sporting events (step 112). The wagering authority calculates the sum of the identification numbers of a subset of the game participants based on the ranking order (step 114). For example, the subset may consist of the first three horses to win a horserace or the top three sports teams in a particular league. The wagering authority also determines whether the wagers placed are winning wagers by comparing the sum of the identification numbers of the subset of game participants to the game number, e.g., the sum may be greater than, less than or equal to the game number (step 116). Finally, the wagering authority calculates the payouts, e.g. on a parimutuel basis (step 118), and provides payouts for winning wagers (step 120).

The wagering game of the present invention may be implemented as an electronic video or computer game to be played in a casino or other gaming establishment or even in a remote location, such as a player's home. The game may also be played via an electronic communications network, e.g., the internet.

Figure 3:
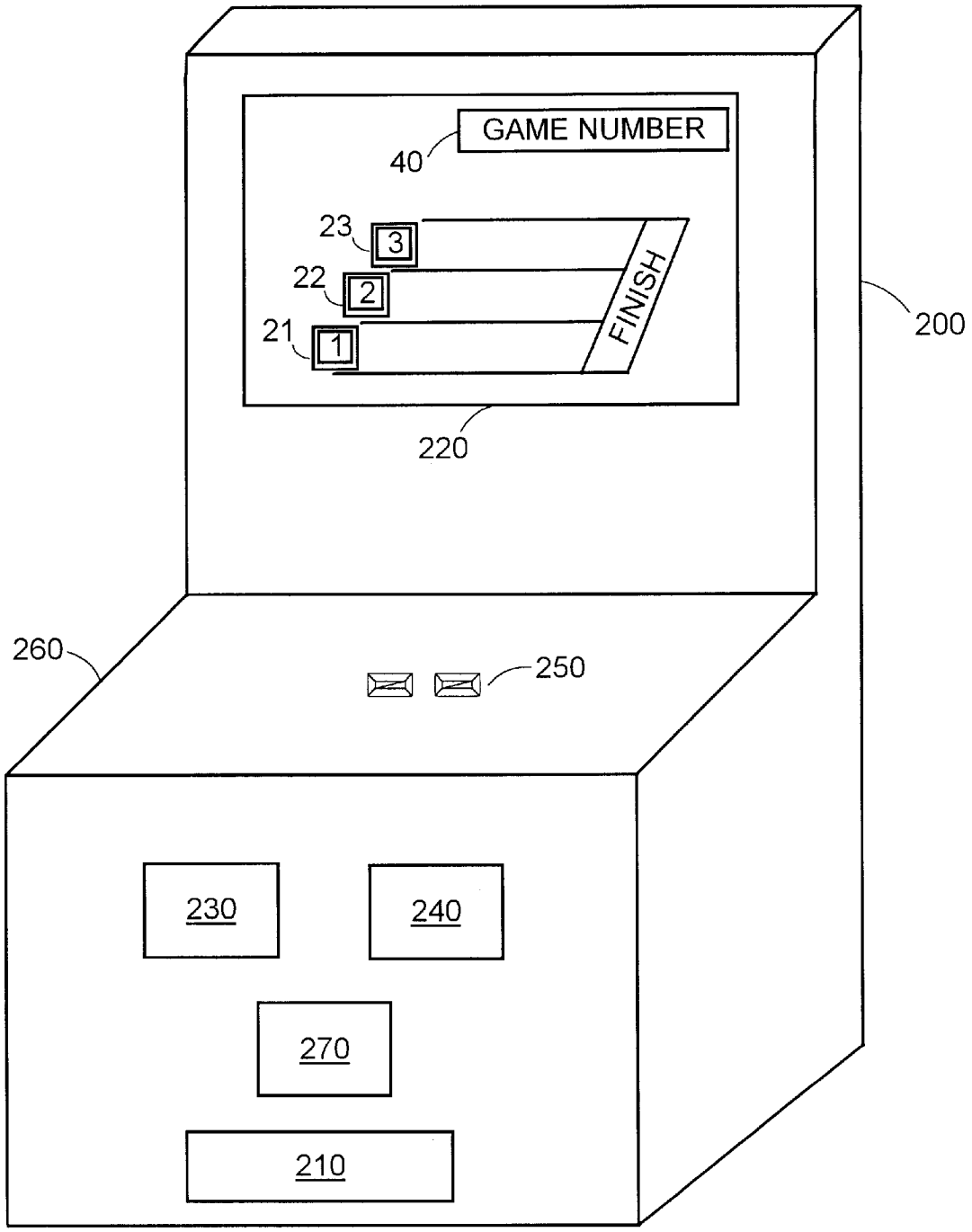
FIG. 3 is a somewhat diagrammatic sketch of an electronic gaming machine for playing the wagering game of the present invention.

As shown in FIG. 3, the electronic game may include a processor 210 in a game machine 200. The player views a screen 220 showing the game participants as identified by their identification numbers and the game number.

A player may play the wagering game of the present invention at game machine 200 by inserting a predetermined amount of money) into a coin slot 230 or a bill collecting device 240. Once the predetermined amount of money has been inserted, the game commences and is displayed to the player on screen 220.

Before processor 210 causes the game participants to participate in an activity that determines their ranking order, such as a race, the player places a wager by pressing buttons 250 on a console 260 of game machine 200, or by touching a touch-sensitive screen 220. Processor 210 then conducts the ranking-order activity, and calculates the sum of the identification numbers of a subset, e.g. three, of the game participants selected on the basis of the ranking-order activity. Processor 210 may also determine whether the player's wager is a winning wager by comparing the sum to the game number.

If the player at game machine 200 has placed a winning wager, processor 210 may calculate the payout. The game machine 200 may either dispense the payout to the player through a payout dispenser 270 or credit an account maintained by processor 210 against which the player may play further games on game machine 200. Payouts determined on a parimutuel basis are possible when multiple players play the same game at similar game machines in communication with game machine 200.

Other embodiments are within the scope of the following claims.

What is claimed is:

1. A method of playing a wagering game by a player, comprising:

selecting a set of game participants;

assigning an identification number to each of the game participants;

selecting a game number;

the player placing a wager based on the game number;

determining a ranking order of the game participants;

calculating the sum of the identification numbers of a subset of the game participants, the subset of game participants comprising a predetermined number of game participants selected on the basis of the ranking order of the game participants; and determining whether the player's wager is a winning wager by comparing the sum to the game number.

2. The method of claim 1 further comprising providing a payout for a winning wager.

3. The method of claim 2 wherein the payout is determined on a parimutuel basis.

4. The method of claim 2 wherein the payout is based on predetermined odds.

5. The method of claim 1 further comprising the player guessing the ranking order of the game participants to place the wager.

6. The method of claim 1 wherein the ranking order is determined by a race.

7. The method of claim 6 wherein the race is a horserace, the game participants are racing horses, and identification numbers are post numbers of the racing horses.

8. The method of claim 1 wherein the ranking order is determined by a series of sporting events and the game participants are sports teams.

9. The method of claim 1 wherein the wager is that the sum is equal to the game number.

10. The method of claim 1 wherein the wager is that the sum is less than the game number.

11. The method of claim 1 wherein the wager is that the sum is greater than the game number.

12. The method of claim 1 wherein the predetermined number is three.

13. The method of claim 1 wherein the game number is selected by a wagering authority.

14. A method of playing a wagering horserace game by a player, comprising:

selecting a set of racing horses;

assigning a post number to each of the racing horses;

selecting a game number;

by the player, placing a wager based on the game number;

determining a finishing order of the racing horses by a horserace;

calculating the sum of the post numbers of the first three racing horses to finish the horserace;

determining whether the player's wager is a winning wager by comparing the sum to the game number; and providing a payout for a winning wager.

15. An electronic gaming device for playing a wagering game by a player, comprising:

a screen displaying a game number and a set of game participants, each game participant being assigned an identification number;

an input device by which the player places a wager relating to the game number;

a processor connected to the screen and the input device for determining a ranking order of the game participants and calculating the sum of the identification numbers of a subset of the game participants, the subset of game participants comprising a predetermined number of game participants selected on the basis of the ranking order; and wherein the processor determines whether the wager is a winning wager by comparing the sum to the game number.

16. The electronic gaming device according to claim 15 wherein the processor calculates a payout to the player for a winning wager and provides the payout.

17. The electronic gaming device according to claim 16 wherein the payout is determined on a parimutuel basis.

18. The electronic gaming device according to claim 16 wherein the payout is based on predetermined odds.

19. The electronic gaming device according to claim 15 wherein the player guesses the ranking order of the game participants to place the wager.

20. The electronic gaming device according to claim 15 wherein the ranking order is determined by a race.

21. The electronic gaming device according to claim 15 wherein the wager is that the sum is equal to the game number.

22. The electronic gaming device according to claim 15 wherein the wager is that the sum is less than the game number.

23. The electronic gaming device according to claim 15 wherein the wager is that the sum is greater than the game number.

24. The electronic gaming device according to claim 15 wherein the input device comprises buttons.

25. The electronic gaming device according to claim 15 wherein the input device comprises a touch sensitive screen.

26. The electronic gaming device according to claim 15 wherein the gaming device is connected to other gaming devices for parimutuel wagering.

27. A method of presenting a wagering game for play by a player, comprising:

selecting a set of game participants;

assigning an identification number to each of the game participants;

selecting a game number;

the player placing a wager relating to the game number;

determining a ranking order of the game participants;

calculating the sum of the identification numbers of a subset of the game participants selected on the basis of the ranking order of the game participants; and determining whether the player's wager is a winning wager by comparing the sum to the game number.

28. The method of claim 27 wherein the subset includes at least two of the game participants.

29. A wagering game method for use by one or more players, comprising:

presenting a set of game participants each having a predetermined identification number;

presenting a game number;

inviting one or more players to place a wager relating to the game number;

calculating a sum of the identification numbers of a subset of the game participants selected on the basis of a ranking order of the game participants; and determining whether any wager is a winning wager by comparing the game number to the sum.

30. The method of claim 29 further comprising providing a payout for a winning wager.

* * * * *